US006739906B2

(12) United States Patent
Lawrence et al.

(10) Patent No.: US 6,739,906 B2
(45) Date of Patent: May 25, 2004

(54) CELL FOR PROTECTING A STRIPPED END OF A CABLE WITH SEALANT

(75) Inventors: John Michael Walmsley Lawrence, Berkshire (GB); Andrew Francis McCaffrey, Berkshire (GB)

(73) Assignee: JTL Systems Limited, Berkshire (GB)

( * ) Notice: Subject to any disclaimer, the term of this patent is extended or adjusted under 35 U.S.C. 154(b) by 0 days.

(21) Appl. No.: 10/108,849

(22) Filed: Mar. 28, 2002

(65) Prior Publication Data

US 2002/0139558 A1 Oct. 3, 2002

(30) Foreign Application Priority Data

Apr. 2, 2001 (GB) ..... 0108198

(51) Int. Cl.[7] ..... H01R 13/52

(52) U.S. Cl. ..... 439/521; 439/936; 439/456; 439/276; 439/687; 174/93

(58) Field of Search ..... 439/521, 276, 439/936, 456, 687, 465, 367; 174/87, 93, 138 F, 76, 92

(56) References Cited

U.S. PATENT DOCUMENTS

| | | | | |
|---|---|---|---|---|
| 3,781,461 | A | * 12/1973 | Thompson et al. | 174/93 |
| 3,992,569 | A | * 11/1976 | Hankins et al. | 174/92 |
| 4,875,952 | A | * 10/1989 | Mullin et al. | 174/92 |
| 5,382,756 | A | * 1/1995 | Dagan | 174/92 |
| 5,962,811 | A | * 10/1999 | Rodrigues et al. | 174/76 |

FOREIGN PATENT DOCUMENTS

| | | |
|---|---|---|
| EP | 0322160 | 6/1989 |

* cited by examiner

*Primary Examiner*—Tho D. Ta
(74) *Attorney, Agent, or Firm*—Andrus, Sceales, Starke & Sawall, LLP

(57) ABSTRACT

A housing (2, 4) for protecting an electrical cable (18) having a sheath and at least one core (20*a*, 20*b*) comprises a cell (8) for containing the stripped end of the sheath, an open cylinder (7) containing a sealant and a plunger (6) for forcing the sealant into the cell so as to seal the end of the sheath.

13 Claims, 4 Drawing Sheets

CELL FOR PROTECTING A STRIPPED END OF A CABLE WITH SEALANT

FIELD OF THE INVENTION

The present invention relates to a protective housing for a cable, and particularly but not exclusively to such a housing for protecting joints between cables from a hostile environment.

BACKGROUND OF THE INVENTION

It is known in the art to provide a connector housing which completely surrounds a stripped cable end and to fill the housing with gel or grease to protect the connection. Examples of such protective housings are disclosed in U.S. Pat. Nos. 4,795,857, 4,883,431, 5,059,748, 6,162,088 and EP-A-0253670. However, such arrangements potentially suffer from under- or overfilling. If under-filled, there will be gas voids within the filling medium. These cause the housing to 'pump' elements from the hostile environment into the housing due to temperature cycling of the housing containing the joint. If the elements include moisture, its expansion on freezing can degrade the integrity of the filling. If overfilled, filling compound is expressed outside the housing. This is undesirable as it attracts dirt and the like.

STATEMENT OF THE INVENTION

According to one aspect of the present invention, there is provided a device for protecting an end of an electrical cable having an outer sheath and at least one core, comprising a cell having a first opening for receiving a part of the electrical cable including the sheath, a second opening for receiving a part of the electrical cable from which the sheath has been removed, such that an end of the sheath is positioned within the cell, and means for introducing a sealant into the cell so as to seal the end of the sheath. This arrangement provides a seal substantially preventing fluids from entering the sheath. Fluids would otherwise enter the sheath and move by capillary action along the cable, potentially causing problems at the other end, such as short-circuiting electronics, penetrating resins, attacking metals and/or other deleterious effects.

Preferably, the electrical cable has a plurality of cores and the cell is provided with a corresponding plurality of said second openings. The sealant seals the interstices between the cores and prevents the ingress of fluids in a hostile environment.

Preferably, the means for introducing the sealant comprises a piston moveable in a cylinder containing the sealant so as to introduce the sealant into the cell. Preferably, the cell forms an end portion of the cylinder.

Preferably, the cell is contained within a housing for housing a connection between the electrical cable and one or more further electrical cables. Preferably, the housing includes one or more further cells for protecting the respective further cables.

Preferably, the housing is provided in at least two parts so that the cable can be positioned within the cell before the at least two parts are assembled together. Preferably, one of the parts carries the means for introducing the sealant and another of the parts carries the part of the cell within which the cable can be positioned.

BRIEF DESCRIPTION OF THE DRAWINGS

A specific embodiment of the present invention will now be described with reference to the accompanying drawings, in which.

DESCRIPTION OF PREFERRED EMBODIMENTS

Figure 1:
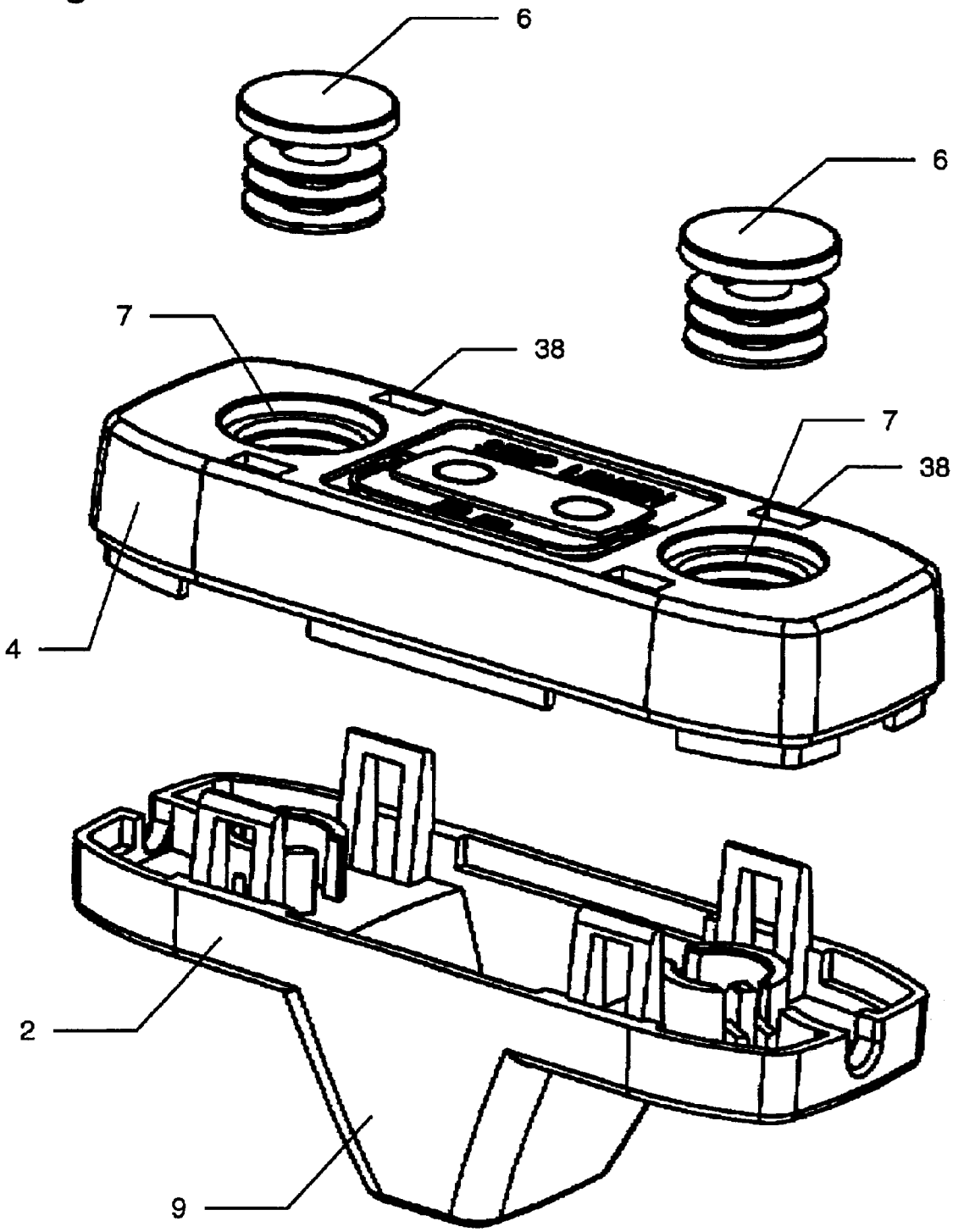
FIG. 1 is an exploded diagram showing the parts of a protective housing in the embodiment.

The specific embodiment comprises a protective housing to protecting a connection between two two-core cables in a hostile environment, such as in the refrigerated envelope of a refrigerated cabinet. This space is wet and normally cold, but is heated periodically for defrosting. The housing comprises a first half 2, including a connector housing portion 9, a second half 4 having a pair of open cylinders 7, and a corresponding pair of plungers 6 for location within the respective open cylinders 7.

The first half 2 and second half 4 are arranged to be snap-fitted together so that their outer walls form the protective housing. The second half 4 is supplied to the user with the plungers 6 located only partially within and projecting out of the open cylinders 7. The inner part of the open cylinders 7 is filled with a suitable sealant, such as grease or other substance which should preferably be anti-static, polymer-safe and suitable for the hostile environment in which the connection is to be made. One example of a suitable grease is Electrolube™ CG53A.

Figure 2A:
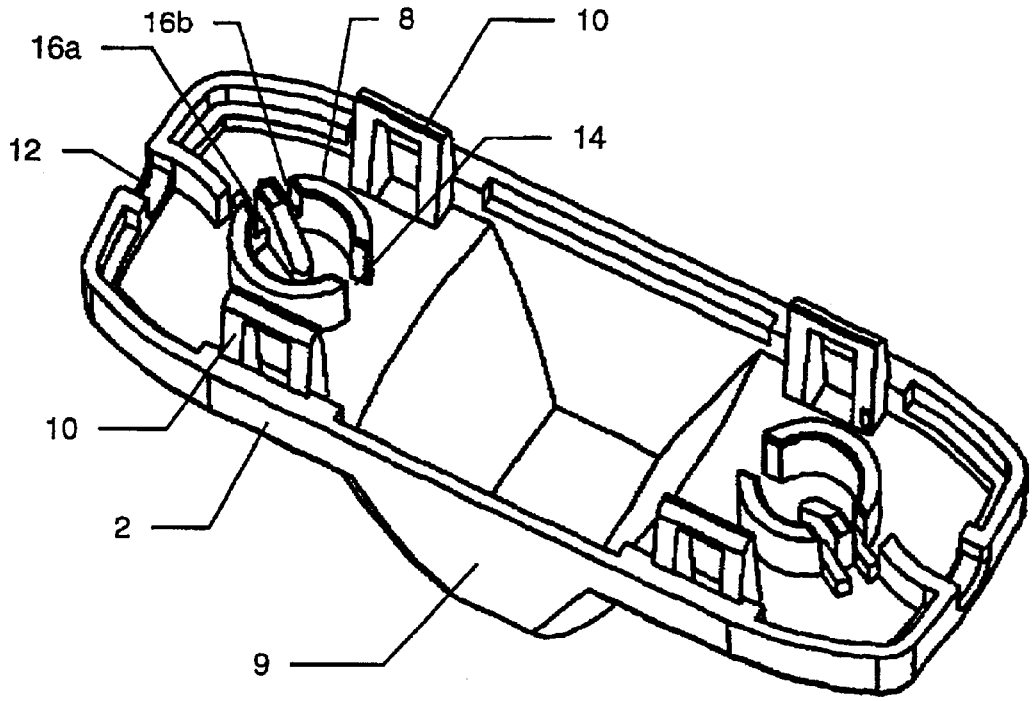
FIG. 2*a* shows a first half of the protective housing.
Figure 2B:
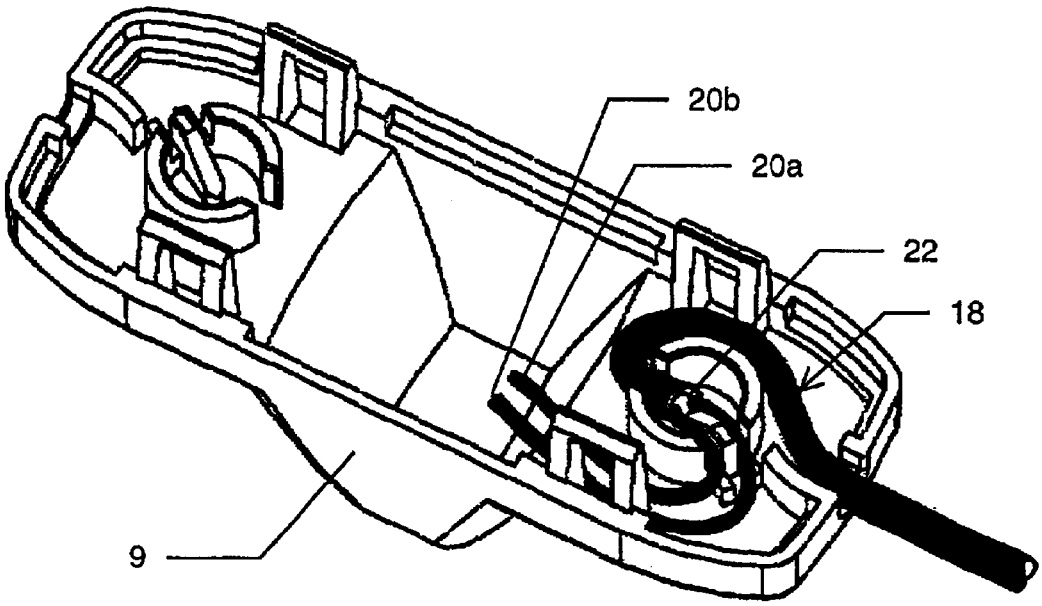
FIG. 2*b* shows the first half with a cable end positioned therein.
Figure 3:
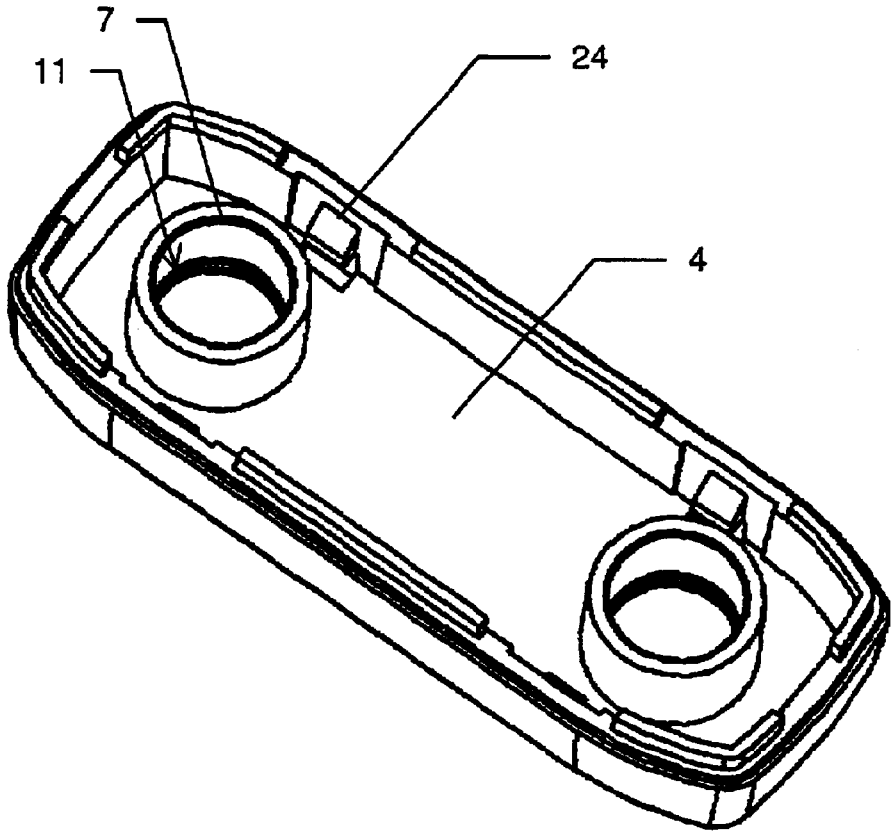
FIG. 3 shows a second half of the protective housing.

As shown in FIGS. 2*a* and 2*b*, the first half 2 includes, at either side of the connector housing portion 9, a cell 8 which forms an extension of the inner walls of the open cylinders 7 when the first half 2 and the second half 4 are fitted together. An opening 12 for an electrical cable 18 is provided at either end of the first half 2.

The electrical cable 18 has a protective sheath and two cores 20*a*, 20*b* each comprising an electrical conductor and an insulating core cladding. As is well known, the protective sheath must be stripped back to expose the cores 20*a*, 20*b* so that a connection can be made to another cable. This creates a 'crutch' where the cores 20*a*, 20*b* meet the end of the sheath. The crutch provides a point where fluids can enter the protective sheath and pass along the cable 18, so as eventually to cause damage to the cable 18 or to apparatus connected to the other end of the cable 18.

Each cell 8 has a first opening 14 for the cable 18 and two second openings 16*a*, 16*b* for the cores 20*a*, 20*b* respectively. The stripped cable 18 is arranged so that the end of the sheath is located within the cell 8 and the cores 20*a*, 20*b* pass out of the cell into the connector housing portion 9. A further cable (not shown) is arranged in the cell 8 at the other side of the first half 2, in the same way. The cores 20*a* and 20*b* of the two cables are then connected together within the connector housing portion 9 using suitable connectors, such as Insulation Displacement Connectors (IDC's). IDC's form electrical connections with the cores using a metallic blade which cuts through the insulating core cladding. One suitable IDC is Scotchlok™ UY2, from 3M™. Since the IDC's cut through the insulating core cladding, it is not necessary to strip back the insulating core cladding from the electrical conductors; however, the insulating core cladding may be stripped back to a point either inside or outside the cell 8, if required and/or if other connector types are used.

Figure 4:
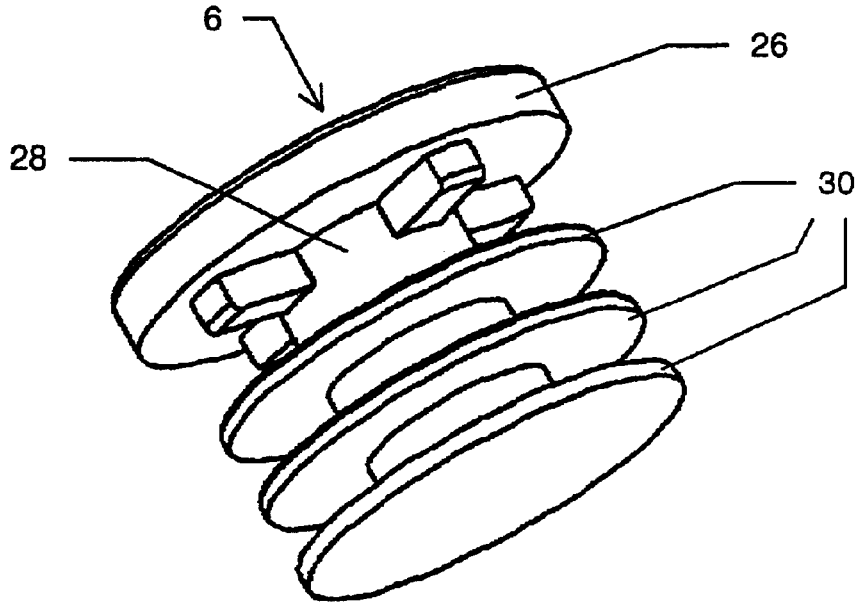
FIG. 4 shows a plunger for location in the second half.
Figure 5:
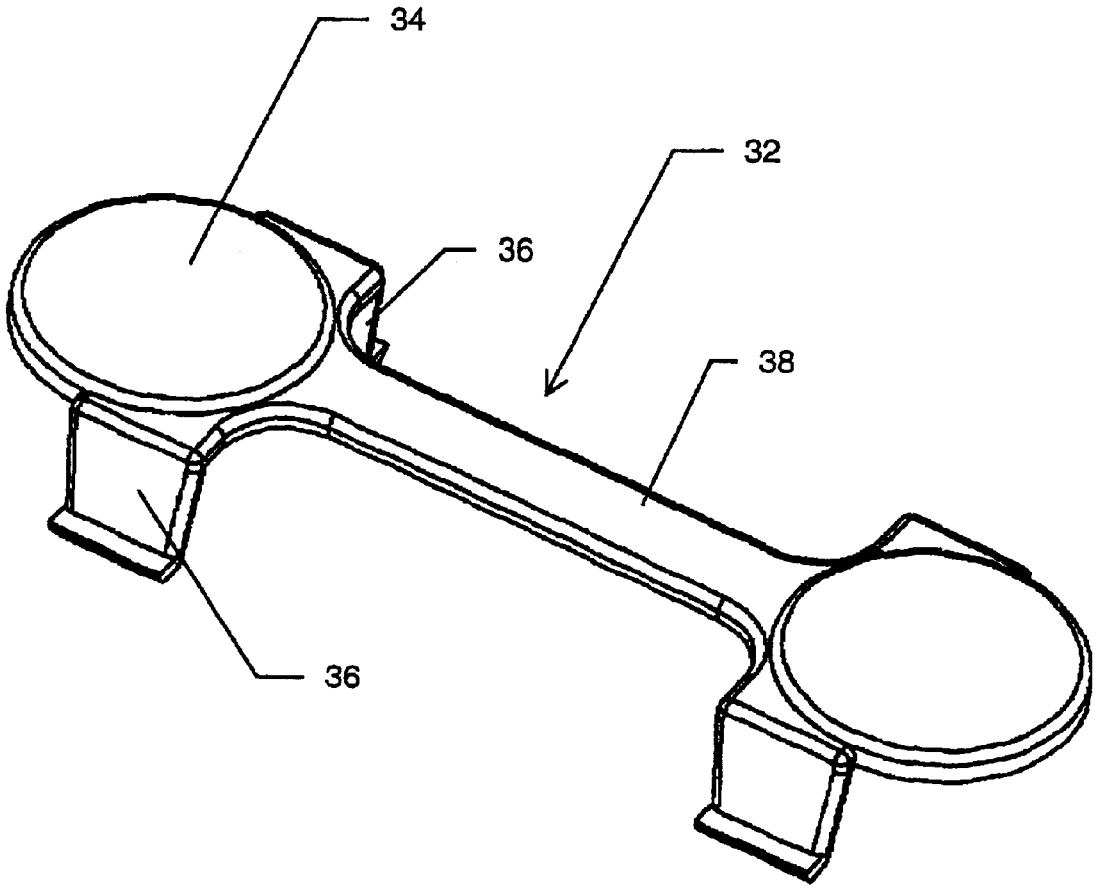
FIG. 5 shows a cover for the plungers in the second half of the housing.

The second half 4, carrying the plungers 6 and grease within the open cylinders 7, is then snap-fitted onto the first half 2 by means of snap-fit connectors 10, 24. As shown in FIG. 4, each of the plungers comprises a button 26, and a stem 28 carrying a plurality of circumferential flanges 30, which engage circumferential ribs 11 within the open cylinders 7 so as to hold the plungers 6 in place. Once the first and second halves 2, 4 of the protective housing have been snap-fitted together, the user pushes the buttons 26 of the plungers 6. The flanges 30 are sufficiently resilient to slide over the circumferential ribs 11, so that the plungers 6 travel into the open cylinders 7 and force the grease into the cells 8. There, the grease surrounds the crutch 22 and seals it against the ingress of fluids. The flanges 30 engage the circumferential ribs 11 and prevent the plungers 6 from falling out.

The cells 8 and the protective housing are not fluid-tight, so that their internal pressure can be equalised with the surrounding pressure and the grease cannot be sucked out of the cells 8. However, the cells 8 prevent the sealant from being washed away, and the protective housing prevents force from being applied to the connection between the cables.

A protective cover 32 may be provided for the second half 4 to prevent the sealant from leaking out from the cylinders 7 during transit. The protective cover 32 has cylinder covers 34, which fit over the cylinders 7, interconnected by a connecting portion 38. The protective cover 32 is secured onto the second half 4 by lugs 36 which fit under the snap-fit connectors 24. The protective cover 32 is removed prior to snap-fitting the first and second halves 2, 4 together.

Alternative embodiments may be envisaged within the scope of the present invention. Although the cells 8 are conveniently integrated within a protective housing which also houses the connectors, the cells 8 may be provided discretely, each with means for fitting onto a discrete open cylinder 7. Alternative embodiments may be designed for cables having more than two cores, with a corresponding number of second openings being provided.

Although the open cylinders advantageously open directly into the cells 8, the cylinders may be provided separately and may be connected to the cells 8 by a passage. Alternatively, the cells may have a grease inlet to which a grease gun is removably connected. Instead of using a plunger and cylinder arrangement to propel the grease into the cell, the sealant may be provided in a reservoir which can be punctured so that the sealant leaks into the cell. The reservoir may be punctured by fitting the two halves of the housing together, Instead of grease, a liquid which sets solid or semi-solid within the cell, or a gel may be used.

These and other variants may nevertheless fall within the spirit and scope of the present invention.

What is claimed is:

1. A protective housing for protecting a connection between at least a first cable and a second cable, each of said first and second cables having a sheath and one or more cores projecting from an end of the sheath, the housing including first and second cells for receiving the ends of the first and second cables respectively, each of said first and second cells having a first opening for receiving the respective first or second cable including the sheath thereof, having one or more second openings for receiving the respective one or more cores without the sheath, and each including means for applying sealant to the end of the sheath within the cell.

2. A protective housing according to claim 1, wherein the housing further includes a connector housing portion for housing a connector for connecting at least one of the cores of the first cable to at least one of the cores of the second cable.

3. A protective housing according to claim 1, wherein said sealant is grease.

4. A protective housing according to claim 1, wherein the means for applying sealant comprises a cylinder and a plunger for forcing the sealant from the cylinder into the respective cell.

5. A protective housing according to claim 4, including a securing arrangement for securing the plunger within the cylinder.

6. A protective housing according to claim 4, including a removable retainer for retaining the sealant in the cylinder.

7. A protective housing according to claim 1, comprising a first part and a second part, the parts being separate or separable to allow the first and second cells to receive a portion of the respective first or second cable including the end of the sheath thereof and being attachable together to protect the end of the sheaths.

8. A protective housing according to claim 7, wherein the first part includes at least part of the cell and the second part includes at least part of the sealant injector.

9. A protective housing according to claim 7, wherein the sealant is retained in the second part when separate from the first part.

10. A protective housing according to claim 4, wherein the cylinder opens directly into the respective cell.

11. A protective housing according to claim 10, comprising a first part and a second part, the parts being separate or separable to allow the first and second cells to receive a portion of the respective first or second cable including the end of the sheath thereof and being attachable together to protect the ends of the sheaths.

12. A protective housing according to claim 11, wherein the first part includes at least part of the first and second cells and the second part includes at least part of the means for applying sealant.

13. A protective housing according to claim 12, wherein the second part includes the cylinder which opens directly into the respective cell when the first part and the second part are attached together.

* * * * *